US008419354B2

(12) United States Patent
Sakai et al.

(10) Patent No.: US 8,419,354 B2
(45) Date of Patent: Apr. 16, 2013

(54) STEAM TURBINE

(75) Inventors: Norio Sakai, Kanagawa-ken (JP); Naoki Shibukawa, Saitama-ken (JP); Hiroshi Ikeda, Kanagawa-ken (JP); Ryozo Udagawa, Kanagawa-ken (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 13/340,913

(22) Filed: Dec. 30, 2011

(65) Prior Publication Data

US 2012/0099967 A1 Apr. 26, 2012

Related U.S. Application Data

(63) Continuation of application No. PCT/JP2010/004229, filed on Jun. 25, 2010.

(30) Foreign Application Priority Data

Jul. 14, 2009 (JP) ..... 2009-166076

(51) Int. Cl.
*F01D 25/32* (2006.01)

(52) U.S. Cl.
USPC ..... 415/169.4; 416/191; 416/192

(58) Field of Classification Search .... 415/169.1–169.4; 416/189–192, 236 R, 236 A
See application file for complete search history.

(56) References Cited

U.S. PATENT DOCUMENTS

| | | | | |
|---|---|---|---|---|
| 3,304,056 | A * | 2/1967 | Sohma | 415/169.4 |
| 5,261,785 | A * | 11/1993 | Williams | 415/169.2 |
| 2006/0269401 | A1* | 11/2006 | Serafini et al. | 415/169.1 |
| 2007/0274824 | A1* | 11/2007 | Burdgick et al. | 415/169.1 |

FOREIGN PATENT DOCUMENTS

| | | | |
|---|---|---|---|
| JP | 11-159302 | | 6/1999 |
| JP | 11159302 | A * | 6/1999 |
| JP | 2004-124751 | | 4/2004 |
| JP | 2004124751 | A * | 4/2004 |

* cited by examiner

*Primary Examiner* — Edward Look
*Assistant Examiner* — William Grigos
(74) *Attorney, Agent, or Firm* — Oblon, Spivak, McClelland, Maier & Neustadt, L.L.P.

(57) ABSTRACT

A steam turbine includes two or more rotating blades and a diaphragm outer ring. Each of the rotating blades includes a tip cover, moisture-trapping grooves, a droplet ejection hole, and a drain guide groove. The tip cover is provided to a tip of each of the rotating blades and is connected in contact with another tip cover adjacent to the tip cover. The moisture-trapping grooves are formed in a longitudinal direction of each of the rotating blades. The droplet ejection hole is to connect an outside of the tip cover on a side of the diaphragm outer ring with an inside of the tip cover. The drain guide groove is to connect ends of the moisture-trapping grooves on the side of the tip cover with the droplet ejection hole. The diaphragm outer ring includes a drain pocket which faces the droplet ejection hole.

9 Claims, 15 Drawing Sheets

STEAM TURBINE

CROSS REFERENCE TO RELATED APPLICATION

This is a Continuation of PCT Application No. PCT/JP2010/004229, filed on Jun. 25, 2010, which is based upon and claims the benefit of priority from the prior Japanese Patent Application No. 2009-166076, filed on Jul. 14, 2009, the entire contents of which are incorporated herein by reference.

FIELD

Embodiments basically relate to a steam turbine provided with a structure to remove moisture attaching to rotating blades thereof.

BACKGROUND

In a steam-power generation plant, a high pressure turbine is combined with an intermediate pressure turbine and a low pressure turbine in many cases. The high pressure turbine is rotated by main steam. The intermediate pressure turbine and the low pressure turbine are rotated also by the main steam which has passed through the high pressure turbine. In the low pressure turbine in which steam pressure is low, temperature and pressure of the steam lower during an expansion process of the steam in a low-pressure stage thereof, and a part of the steam condenses into moisture. Influence of the moisture on the steam turbine will be described below with reference to the drawings.

FIG. 11 is a view showing a turbine nozzle 101 and a turbine rotating blade 102 at the final stage of the low pressure turbine, both being viewed from a meridian plane of the low pressure turbine. The nozzle 101 is supported by a diaphragm inner ring 103 and a diaphragm outer ring 104. The turbine rotating blade 102 is planted on a turbine rotor 105. A rotating blade cover 106 is arranged on the upper end of the turbine rotating blade 102. This rotating blade cover 106 connects in contact with another rotating blade covers 106 adjacent thereto to suppress vibration of the tip of the rotating blade 102. The rotating blade cover 106 also prevents steam from flowing out of a blade row of turbine rotating blades 102.

In FIG. 11, the turbine nozzle 101 shows a leading edge thereof and the turbine rotating blade 102 shows a suction side thereof when viewed on the paper. Steam condenses on the surface of the leading edge of the turbine nozzle 101 to generate moisture. The moisture attaches to the leading edge of the turbine nozzle 101 to collect, thereby forming a liquid film 107.

FIG. 12 is a view showing a section cut along the line XII-XII in FIG. 11. The liquid film 107 reaches a rear edge 108 of the turbine nozzle 101 and changes into water droplets 109 to fly off from the back edge 108. The arrow denotes a scattering direction of the water droplets 109 in FIG. 12. On the scattering, steam energy is used for acceleration of the water droplets 109 and is, therefore, consumed.

The water droplets 109 cannot move completely into a steam flow as a result of inertia thereof. This event causes the water droplets 109 to collide with the suction side 110 of the turbine rotating blade 102 which is rotating. The collision of the water droplets 109 with the suction side of the turbine rotating blade 102 serves as a retarding force against the rotation of the turbine rotating blade 102, and reduces turbine efficiency. The turbine rotating blade 102 is likely to be eroded because the water droplets 109 attach to the suction side 110 of the turbine rotating blade 102.

As described above, the moisture attaching to the turbine rotating blade 102 has an adverse effect on efficiency and reliability of a turbine. On the other hand, there is known a steam turbine provided with a structure to remove attached moisture. Such a device will be described below with reference to FIGS. 13 and 14.

FIG. 13 is a sectional view showing a turbine nozzle 101 being viewed from a meridian plane thereof. A device shown in FIG. 13 is provided to the turbine nozzle 101 of a hollow structure having a slit 111 on a front-side surface thereof so that moisture attached to the leading edge surface is introduced into the inside of the turbine nozzle 101 via the slit 111.

FIG. 14 is a sectional view showing the turbine rotating blade 102 being viewed from a meridian plane thereof. A device shown in FIG. 14 arranges grooves 112 extending in the longitudinal direction of the rotating blade on a suction side surface 110 of the rotating blade 102 so that moisture attached to the grooves 112 is collected to a drain pocket 113 formed inside the diaphragm outer ring 104 by centrifugal force of the turbine rotating blade 102. FIG. 15 is a perspective view of the turbine rotating blade 102 shown in FIG. 14. As shown in FIG. 15, the rotating blade cover 106 is arranged so that the end face thereof coincides approximately with a front outside-edge of the suction side surface 110 of the turbine rotating blade 102 and the grooves 112 are arranged from the suction side surface 110 of the turbine rotating blade 102 to the end face thereof. As another embodiment, there is disclosed a configuration which provides the rotating blade cover 106 with a moisture ejection hole connecting to the grooves 112.

The device shown in FIG. 13 is provided with the slit 111 on the turbine nozzle 101 to remove moisture. However, such a device is likely to take in not only moisture but also steam via the slit 111 into the inside of the turbine nozzle 101. The steam flowed into the inside of the turbine nozzle 101 may have no contribution to rotation of a turbine, thereby reducing turbine efficiency. The turbine nozzle 101 is needed to be hollow and is therefore more difficult to manufacture than a normal turbine nozzle 101.

On the other hand, the device shown in FIGS. 14 and 15 provides the turbine rotating blade 102 with the grooves 112 to collect moisture into the drain pocket 113. The device requires nothing other than forming the grooves 112 on the turbine rotating blade 102. Therefore, the turbine rotating blade 102 having such a device is easy to manufacture. A small amount of steam flows outside the rotating blade cover 106. Therefore, steam flowing into the drain pocket 113 is less than steam flowing into the slit 111. In other words, the device providing the turbine rotating blade 102 with the grooves 112 has less impact on turbine efficiency than the device providing the turbine rotating blade 102 with a hollow and the slit 111.

As mentioned above, the device providing the turbine rotating blade 102 with the grooves 112 has less impact on turbine efficiency than the device providing the turbine rotating blade 102 with a hollow and the slit 111. However, steam is likely to flow out of the grooves 112 to the outside of the rotating blade cover 106.

The nearer the final stage of the turbine rotating blade 102, the more moisture attaching to the turbine rotating blade 102 is. When the number of the grooves 112 is increased to deal with an increase in moisture, the number of the grooves 112 passing through the connected rotating blade covers 106 or the number of exhaust nozzles for water droplets is also increased. This increases an amount of steam flowing out of the rotating blade cover 106.

It is also necessary to enlarge the entrance width of the drain pocket 113 in connection with increasing the number of the grooves 112. When enlarging the entrance width of the drain pocket 113, the amount of the steam flowing into the drain pocket 113 also increases. When the drain pocket 113 is located on the vertically upper side of the turbine rotating blade 102, moisture is likely to collide with the inside wall of the drain pocket 113 having a wide entrance and to reflect on the inside wall. In such a case, the moisture is likely to fall from the wide entrance to the side of the turbine rotating blade 102.

BRIEF DESCRIPTION OF THE DRAWINGS

Aspects of this disclosure will become apparent upon reading the following detailed description and upon reference to the accompanying drawings.

DESCRIPTION

As will be described later, in accordance with an embodiment, a steam turbine includes two or more rotating blades and a diaphragm outer ring. Each of the rotating blades includes a tip cover, moisture-trapping grooves, a droplet ejection hole, and a drain guide groove. The tip cover is provided to a tip of each of the rotating blades and is connected in contact with another tip cover adjacent to the tip cover. The moisture-trapping grooves are formed in a longitudinal direction of each of the rotating blades on a leading edge of each of the rotating blades. The droplet ejection hole is formed so that the droplet ejection hole connects an outside of the tip cover on a side of the diaphragm outer ring with an inside of the tip cover on a side of each of the rotating blade. The drain guide groove is formed so that the drain guide groove connects ends of the moisture-trapping grooves on the side of the tip cover with the droplet ejection hole. The diaphragm outer ring includes a drain pocket which faces the droplet ejection hole.

Embodiments will be described below with reference to the drawings.

First Embodiment

Figure 1:
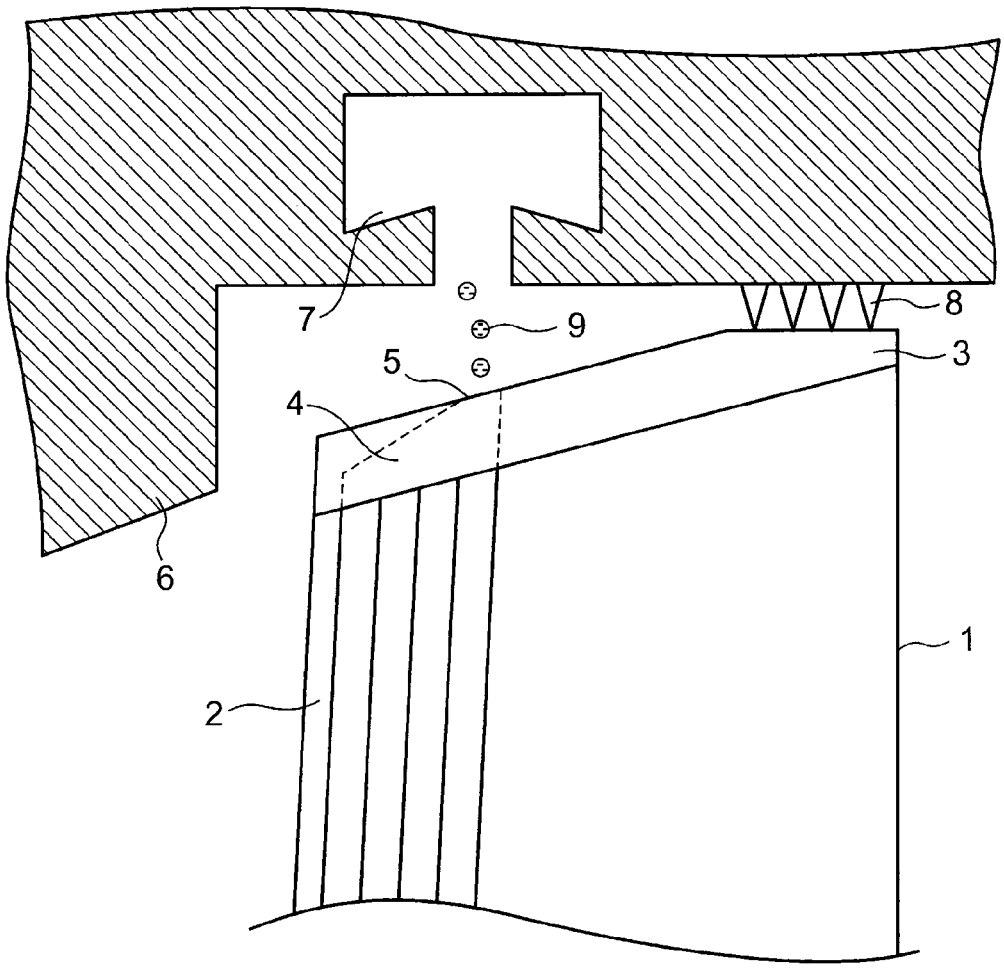
FIG. 1 is a meridional view enlarging a tip portion of a rotating blade of a steam turbine.

A structure of a steam turbine in accordance with a first embodiment will be described below with reference to FIG. 1. FIG. 1 is a meridional view enlarging a tip portion of a rotating blade 1 of a steam turbine.

The rotating blade 1 is planted on a turbine rotor (not shown). In FIG. 1, the rotating blade shows a suction side thereof when viewed on the paper. FIG. 1 is drawn such that steam flows from the left to the right on the paper. The rotating blade 1 will be described below, provided that the left and the right are a front and a rear of the rotating blade, respectively.

Two or more moisture-trapping grooves 2 are formed on the front edge of the rotating blade 1 viewed from the suction side of the rotating blade 1. Moisture comes from the nozzle (not shown) to attach to the moisture-trapping grooves 2. A tip cover 3 is arranged on the upper end of the rotating blade 1. The tip cover 3 connects in contact with another tip cover 3 on the adjacent rotating blade 1, thereby suppressing vibration of the tips of the rotating blades 1. The tip cover 3 also prevents steam from flowing out of a blade row of the rotating blades 1, thereby preventing a reduction in turbine efficiency.

A drain guide groove 4 is formed through the tip cover 3 on the top side of the rotating blade 1. The nearer the rear of the rotating blade 1, the deeper the drain guide groove 4 becomes. The drain guide groove 4 connects to a droplet ejection hole 5 formed on the surface of the tip cover 3.

A diaphragm outer ring 6 is arranged outside the rotating blades 1. A drain pocket 7 is formed in the diaphragm outer ring 6. The drain pocket 7 is located outside the droplet ejection hole 5 when the drain pocket 7 is viewed from the rotation axis of the rotating blades 1. Tip fins 8 are mounted on the diaphragm outer ring 6. The mounting position thereof is located between the diaphragm outer ring 6 and the trailing edge of the rotating blade 1 both facing each other. The tip fins 8 serve as channel resistance of a gap between the tip cover 3 and the diaphragm outer ring 6 to reduce the amount of steam passing through the gap.

Figure 2:
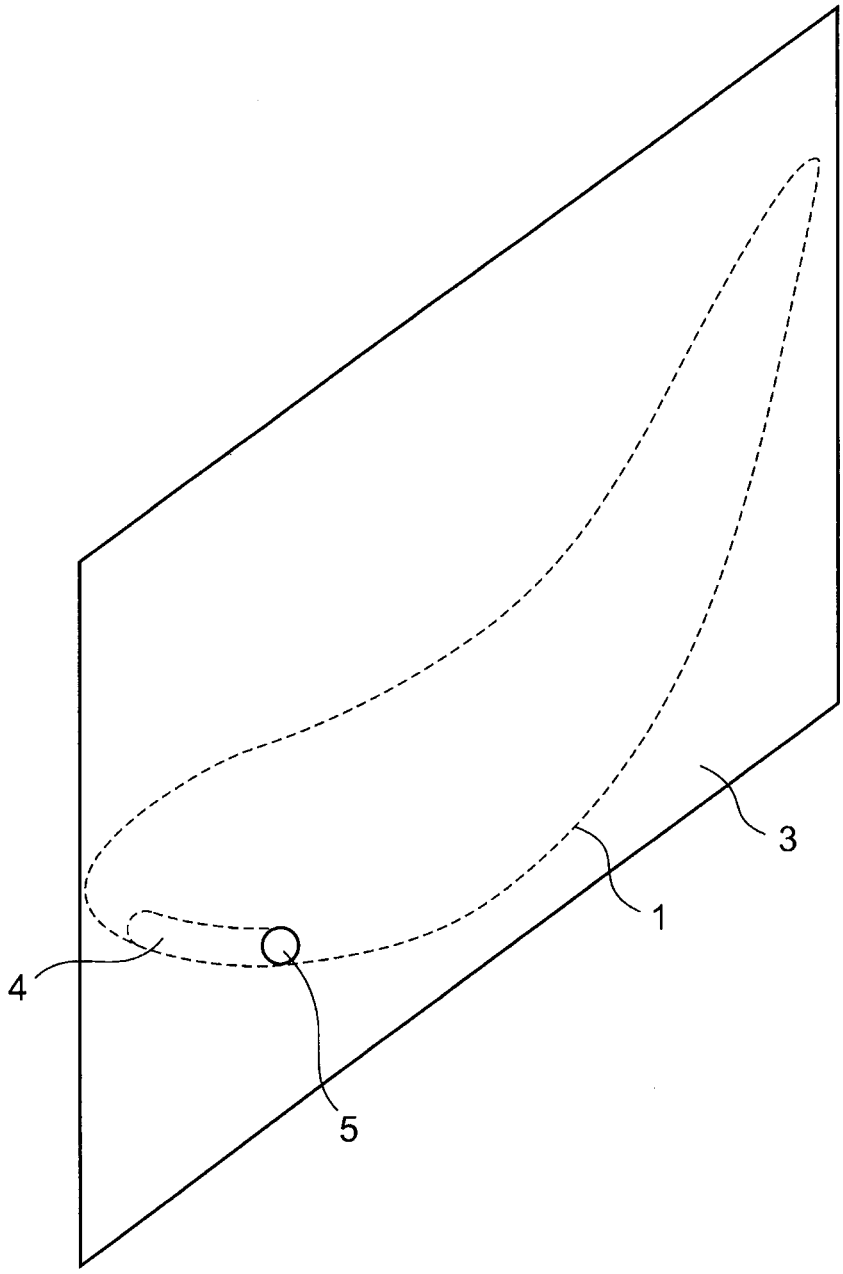
FIG. 2 is a top view showing a structure of the rotating blade.

The position of the drain guide groove 4 will be described in detail with reference to FIG. 2. FIG. 2 is a top view of the rotating blade 1. The droplet ejection hole 5 opens on the side of the tip cover 3 toward the under face of the diaphragm outer ring 6 to be connected with the drain guide groove 4. The drain guide groove 4 is provided such that the drain guide groove 4 is in contact with ends of the moisture trapping grooves 2 and follows the suction side of the rotating blade 1.

A function of the rotating blade 1 having such a structure will be described with reference to FIG. 1. Moisture flied off from a nozzle not shown attaches to the rotating blade 1 to enter the moisture trapping grooves 2 during operation of the steam turbine. The nozzle not shown is located in the front of the rotating blade 1. The moisture trapped in the moisture trapping grooves 2 moves towards the tip cover 3 as a result of centrifugal force due to rotation of the turbine. The moisture reaches the ends of the moisture trapping grooves 2 on the side of the tip cover 3 to further move to the drain guide groove 4. Once the moisture enters the drain guide groove 4, the moisture moves to the droplet ejection hole 5 along the drain guide groove 4 as a result of centrifugal force of the rotating blade 1, and flies out as being water droplets 9. The water droplets 9 which have flied out are trapped in the drain pocket 7.

As described above, it is possible to trap moisture attached to the moisture-trapping grooves 2 in the drain pocket 7 by guiding moisture to the droplet ejection hole 5 via the drain guide groove 4. As a result, even when increasing the number of moisture-trapping grooves 2, the number of droplet ejection holes 5 is not needed to be increased. The droplet ejection holes 5 are to be formed so that the side of the tip cover 3 on the side of the rotating blade is in communication with the other side of the tip cover on the side of the diaphragm outer ring 6. Accordingly, it is possible to make smaller the amount of steam which flows out of the droplet ejection hole 5 into the side of the diaphragm outer ring 6 than before.

Increasing the number of the moisture-trapping grooves 2 does not require widening the entrance of the drain pocket 7, thereby allowing it to make the amount of the steam flowing into the drain pocket 7 smaller than before.

As described above, the steam turbine in accordance with the embodiment reduces loss of steam, thereby enabling it to make turbine efficiency higher than before.

The embodiment has been described under the assumption that the nearer the rear of the rotating blade 1, the deeper the drain guide groove 4 is.

Figure 3:
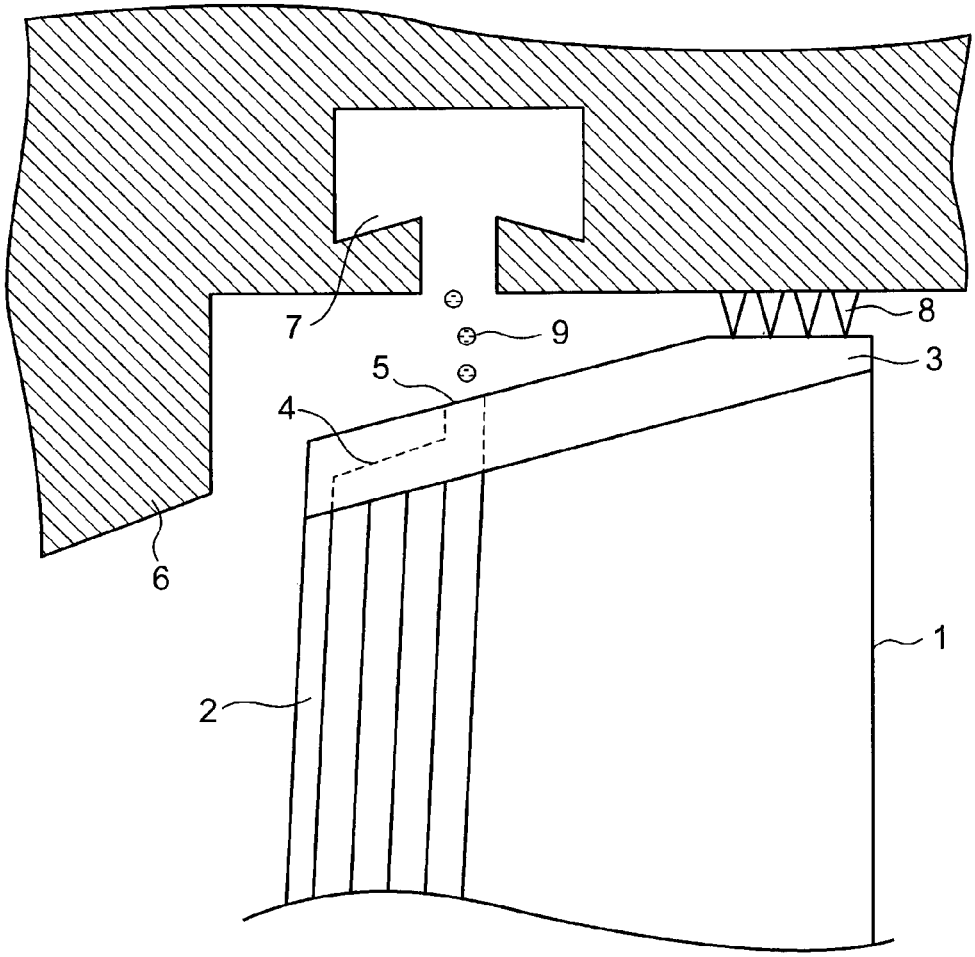
FIG. 3 is a meridional view enlarging a tip portion of another rotating blade of the steam turbine.

Alternatively, the depth of the drain guide groove 4 may be constant if the bottom of the drain guide groove 4 sinks toward the rear of the rotating blade 1 and in the radial direction of the turbine. For example, when the tip of the rotating blade 1 inclines as shown in FIG. 3, the bottom of the drain guide groove 4 is configured to approach the diaphragm outer ring 6 nearer the rear of the rotating blade 1, thereby bringing the same result as that shown in FIG. 1. FIG. 3 is a meridional view enlarging a tip portion of another rotating blade of the steam turbine.

Second Embodiment

A steam turbine in accordance with a second embodiment will be described below with reference to FIG. 4. Wherever possible, the same reference numerals as those of the first embodiment will be used to denote the same or like parts throughout FIG. 4. The same explanation will not be repeated.

Figure 4:
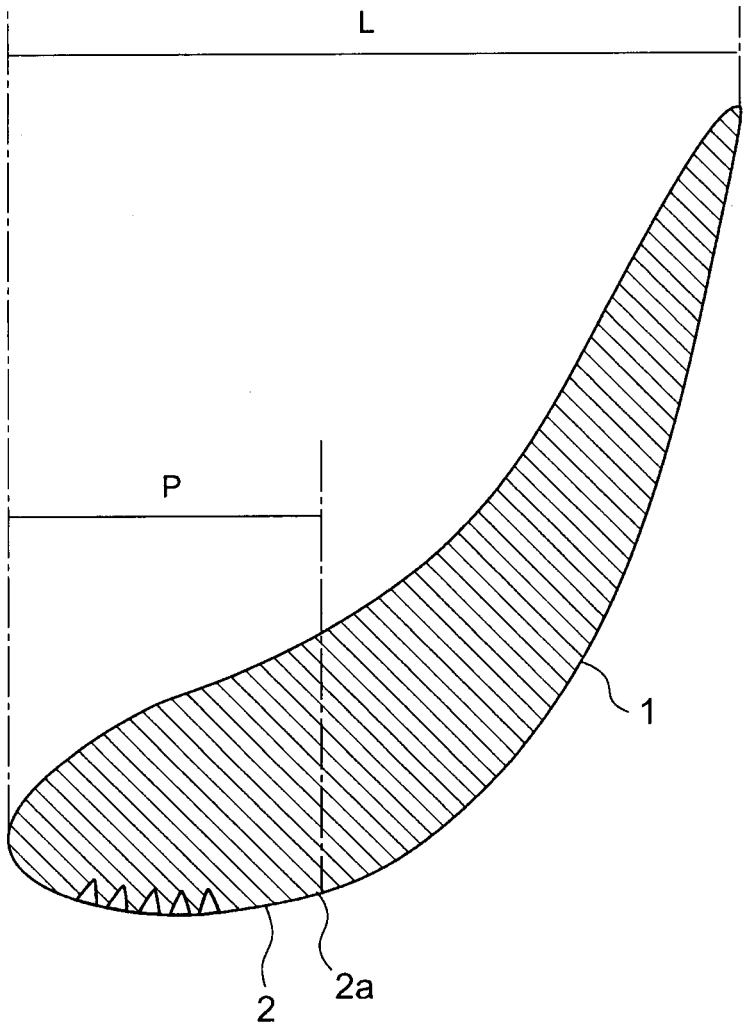
FIG. 4 is a transversely sectional view showing an outline of a rotating blade in accordance with the second embodiment.

FIG. 4 is a transversely sectional view showing an outline of a rotating blade 1 in accordance with the second embodiment. In this embodiment, two or more moisture-trapping grooves 2 are formed in an area determined by the following formula (1), provided that:

- L is a cord length in the axis direction of the rotating blade 1;
- P is a length between a moisture-trapping groove 2*a* and the front edge of the rotating blade 1; and
- the moisture-trapping groove 2*a* is located in the most downstream side among the moisture-trapping grooves 2.

$$P/L<0.5 \quad (1)$$

Evaluating loca of moisture in a blade row of rotating blades 1 clarifies that most of the moisture coming from a nozzle not shown collides with the area of the rotating blade 1 determined by the formula (1). Therefore, forming two or more moisture-trapping grooves 2 in the area determined by the formula (1) enables it to efficiently remove moisture which attaches to the rotating blades 1.

The steam turbine of this embodiment enables it to more efficiently remove moisture attaching to the rotating blades 1 in addition to the same effect as that of the first embodiment.

Third Embodiment

A steam turbine in accordance with a third embodiment will be described below with reference to FIGS. 5 and 6. Wherever possible, the same reference numerals as those of the first embodiment will be used to denote the same or like parts throughout FIGS. 5 and 6. The same explanation will not be repeated.

Figure 5:
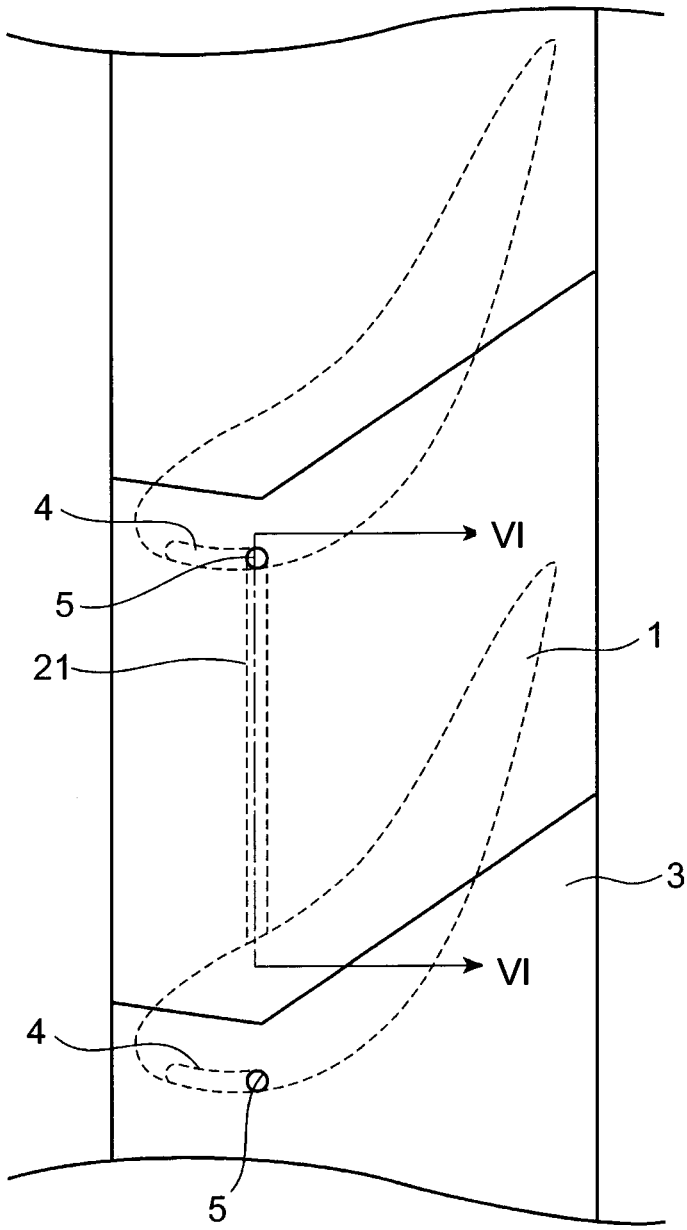
FIG. 5 is a top view of a blade row of rotating blades in accordance with a third embodiment.

FIG. 5 is a top view of a blade row of rotating blades 1 in accordance with the third embodiment. A second drain guide groove 21 is formed on the under face of a tip cover 3. This second drain guide groove 21 is formed substantially in the circumferential direction of the steam turbine so that the second drain guide groove 21 crosses between two adjacent rotating blades 1. The second drain guide groove 21 is connected to the droplet ejection hole 5. The tip cover 3 is arranged so that the second drain guide groove 21 may not cross the end faces of the tip cover 3. Steam flows in the direction from the left to the right in FIG. 5.

Figure 6:
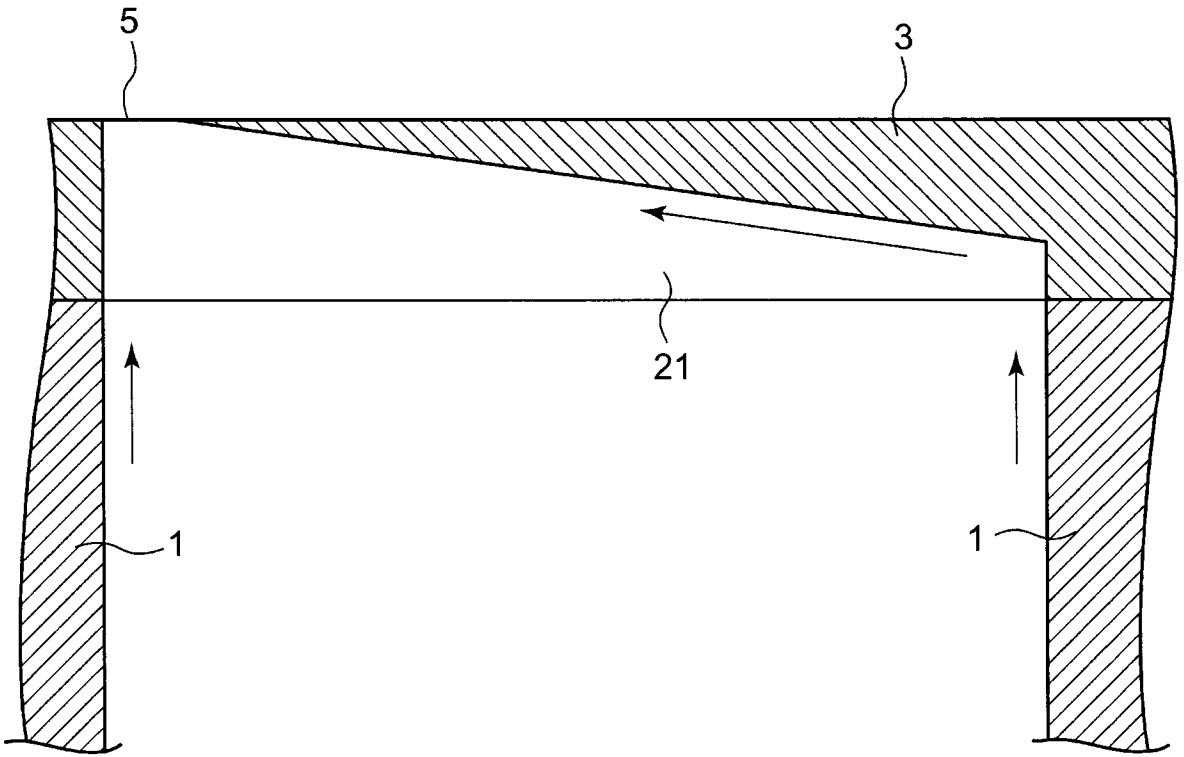
FIG. 6 is a view showing a section cut along the VI-VI line in FIG. 5.

A structure of the second drain guide groove 21 will be described in detail with reference to FIG. 6. FIG. 6 is a view showing a section cut along the VI-VI line in FIG. 5. As shown in FIG. 6, the second drain guide groove 21 is formed so that:

- the nearer a droplet ejection hole 5, the deeper the second drain guide groove 21 becomes.
- The arrows in FIG. 6 denote substantially a moving direction of water droplets and moisture attached to a rotating blade 1.

A function of the second drain guide groove 21 will be described below. Centrifugal force acts on water droplets coming from a nozzle (not shown) or on moisture in steam. As a result of the centrifugal force, a portion of the water droplets or the moisture is likely to attach to the inside surface of the tip cover 3. Once the droplets or the moisture attached goes into the second drain guide groove 21, the droplets or the moisture moves to a droplet ejection hole 5 as a result of the centrifugal force. Eventually the droplets or the moisture is ejected from the droplet ejection hole 5 to be collected into a drain pocket 7.

In accordance with the steam turbine of this embodiment, the second drain guide groove 21 enables it to remove moisture attached to the surface of the tip cover 3 on the side of the rotating blade 1 in the same way as removing moisture attached to the rotating blade 1. The second drain guide groove 21 is formed on the under surface of the tip cover 3. This is a new effect in addition to that of the first embodiment.

Fourth Embodiment

A fourth embodiment will be described below with reference to the drawings. Wherever possible, the same reference numerals as those of the first embodiment will be used to denote the same or like parts throughout the drawings. The same explanation will not be repeated.

Figure 7:
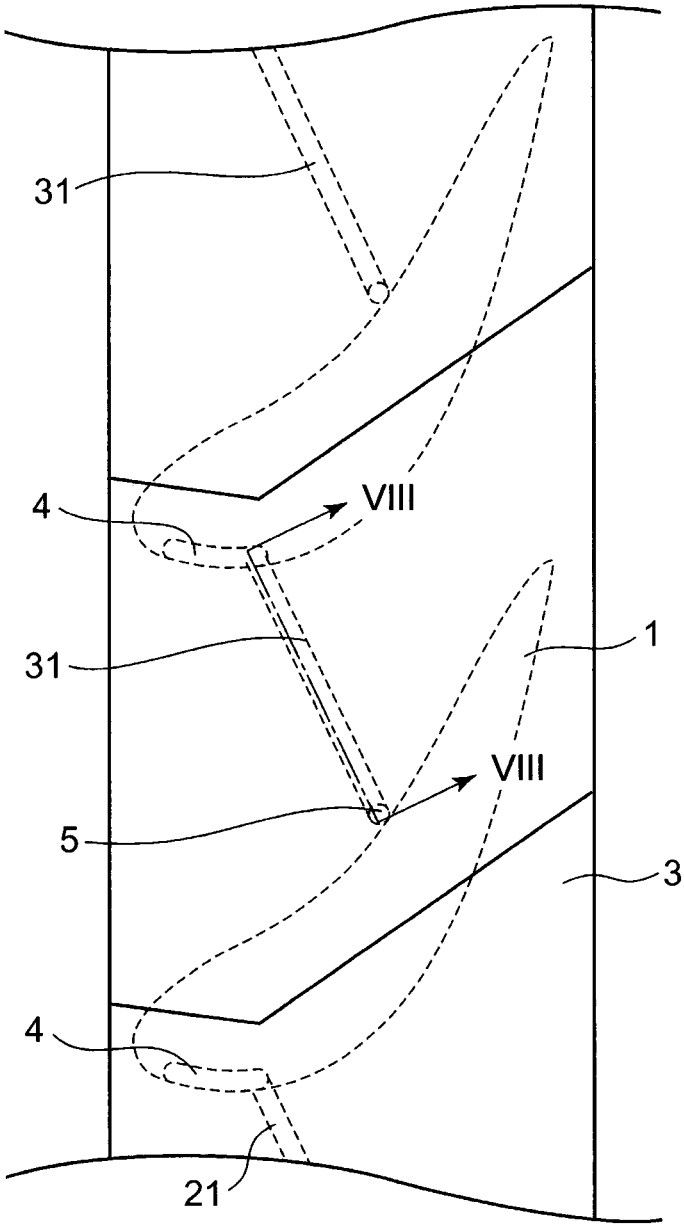
FIG. 7 is a top view showing a rotating blade of a fourth embodiment.

FIG. 7 is a top view showing a rotating blade 1 of the fourth embodiment. A drain guide groove 4 formed on a rotating blade 1 connects with a second drain guide groove 31 formed on a side surface of a tip cover 3 on the side of the rotating blade 1. A droplet ejection hole 5 is formed on the suction side of the rotating blade 1. The second drain guide groove 31 is arranged obliquely to the rotation axis of the rotating blade 1 and connects the drain guide groove 4 to the droplet ejection hole 5.

Figure 8:
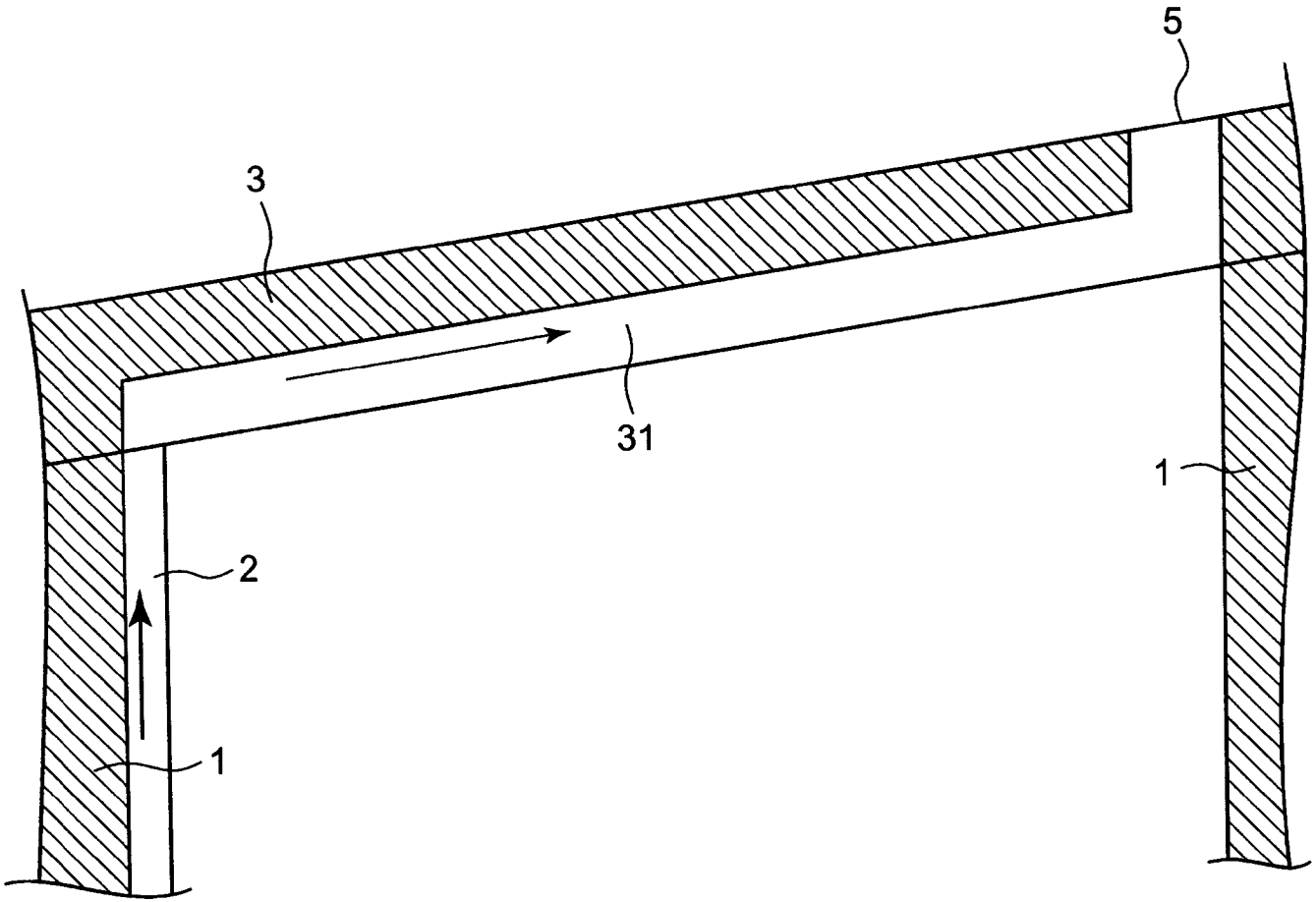
FIG. 8 is a view showing a section of a tip cover cut along a VIII-VIII line shown in FIG. 7.

The second drain guide groove 31 will be described in detail with reference to FIG. 8. FIG. 8 is a view showing a section of the tip cover 3 cut along the VIII-VIII line in FIG. 7. The arrows in FIG. 8 denote substantially a movement direction of water droplets and moisture attached to the rotating blade 1.

The depth of the second drain guide groove 31 is fixed. The tip cover 3 inclines so that:

the nearer the backward of a turbine, the nearer the circumference of the turbine.

Accordingly, the second drain guide groove 31 inclines so that: the nearer the droplet ejection hole 5, the nearer the circumference of the turbine.

For this reason, moisture moves to the droplet ejection hole 5 and is then ejected therefrom to a drain pocket 7 as a result of centrifugal force. Just before the discharge, once the moisture attaches to the drain guide groove 4 or the surface of the tip cover 3 on the side of the rotating blade 1, the moisture goes into the second drain guide groove 31.

In accordance with a steam turbine of the embodiment, it is possible to effectively remove the moisture attached to the surface of the tip cover 3 on the side of the rotating blade 1 in the same way as removing moisture attached to the rotating blade 1. This is a new effect in addition to the same effect of the first embodiment.

Figure 9:
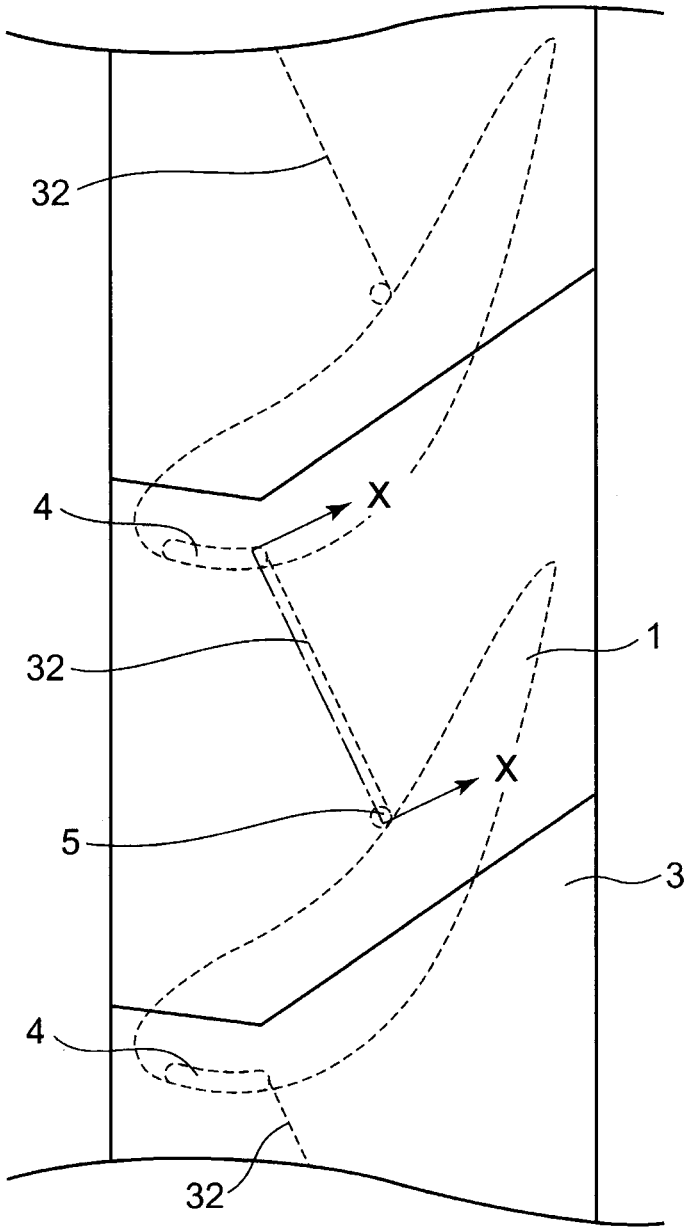
FIG. 9 is a top view showing a rotating blade in accordance with a modified example of the fourth embodiment.

A steam turbine in accordance with a modified example of the fourth embodiment will be described with reference to FIG. 9. FIG. 9 is a top view showing a rotating blade 1 in accordance with the modified example of the fourth embodiment. This modified example is provided with a drain guide weir 32 instead of the second drain guide groove 31. This drain guide weir 32 is a weir which is provided to a surface of a tip cover 3 on the side of a rotating blade 1 so that the drain guide weir 32 protrudes toward the side surface. Once moisture goes into a moisture-trapping groove 2, the moisture moves to a droplet ejection hole 5 via a drain guide groove 4 and the drain guide weir 32. The moisture attached on the side of the tip cover 3 which is more upstream than the drain guide weir 32 moves to the drain guide weir 32 and further moves down the drain guide weir 32 to the droplet ejection hole 5.

As described above, arranging the drain guide weir 32 instead of the second drain guide groove 31 allows it to acquire the same effect as that of the fourth embodiment.

Fifth Embodiment

A fifth embodiment will be described below with reference to a drawing. Wherever possible, the same reference numerals as those of the first embodiment will be used to denote the same or like parts throughout the drawing. The same explanation will not be repeated.

Figure 10:
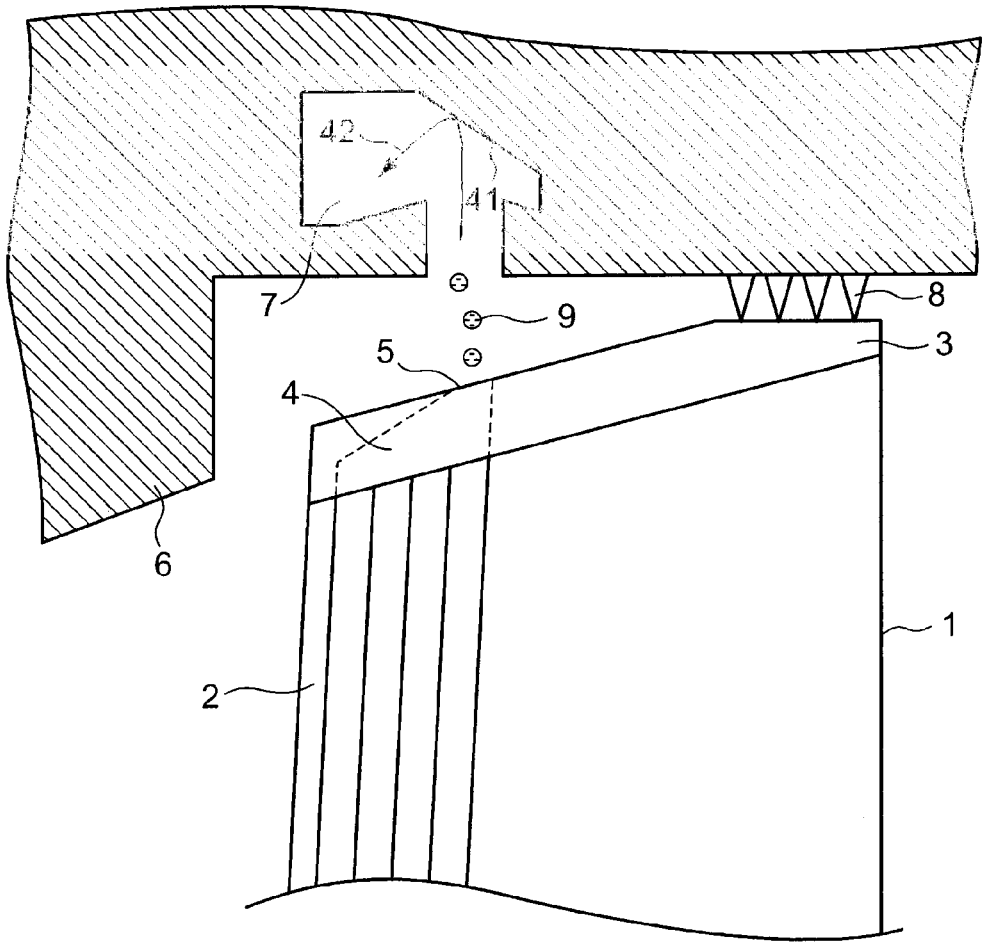
FIG. 10 is a meridional view enlarging a tip portion of a rotating blade in accordance with a fifth embodiment.
Figure 11:
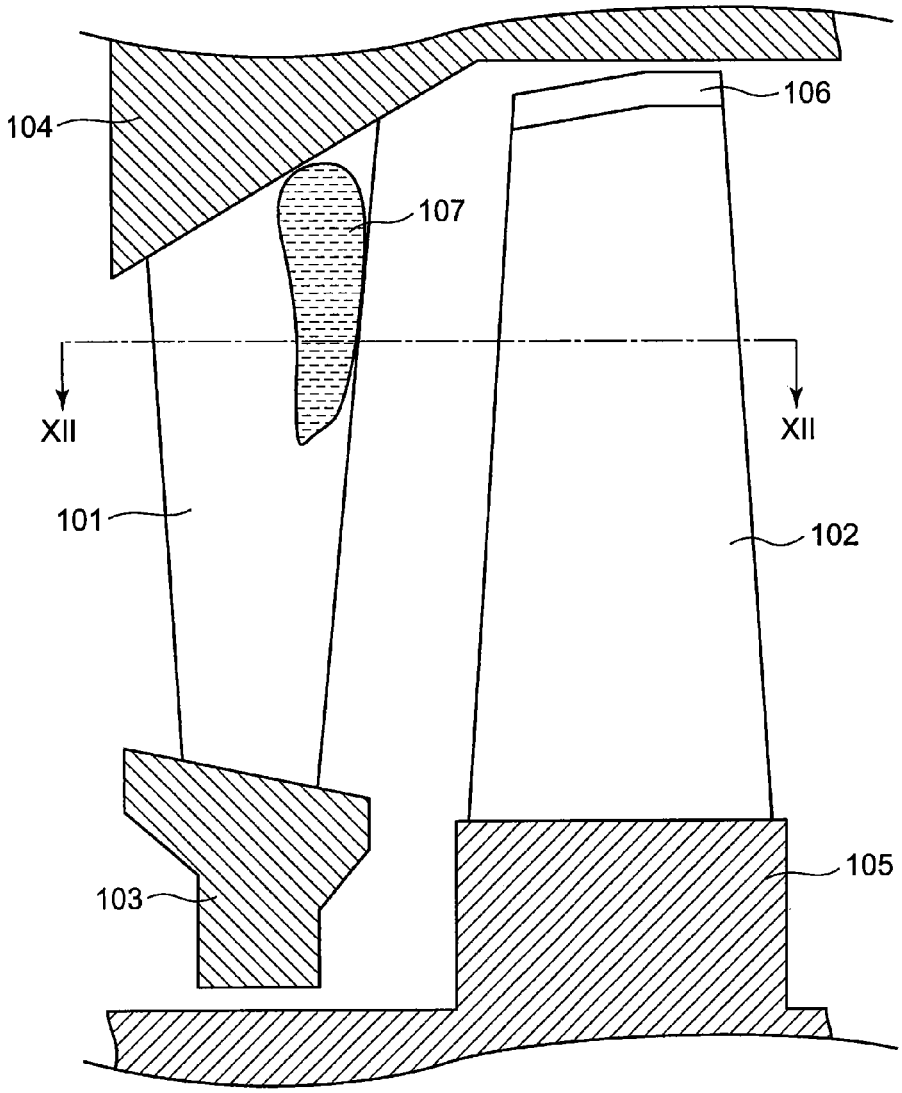
FIG. 11 BACKGROUND ART
FIG. 11 is a view showing a turbine nozzle and a turbine rotating blade at the final stage of a conventional low-pressure turbine
Figure 12:
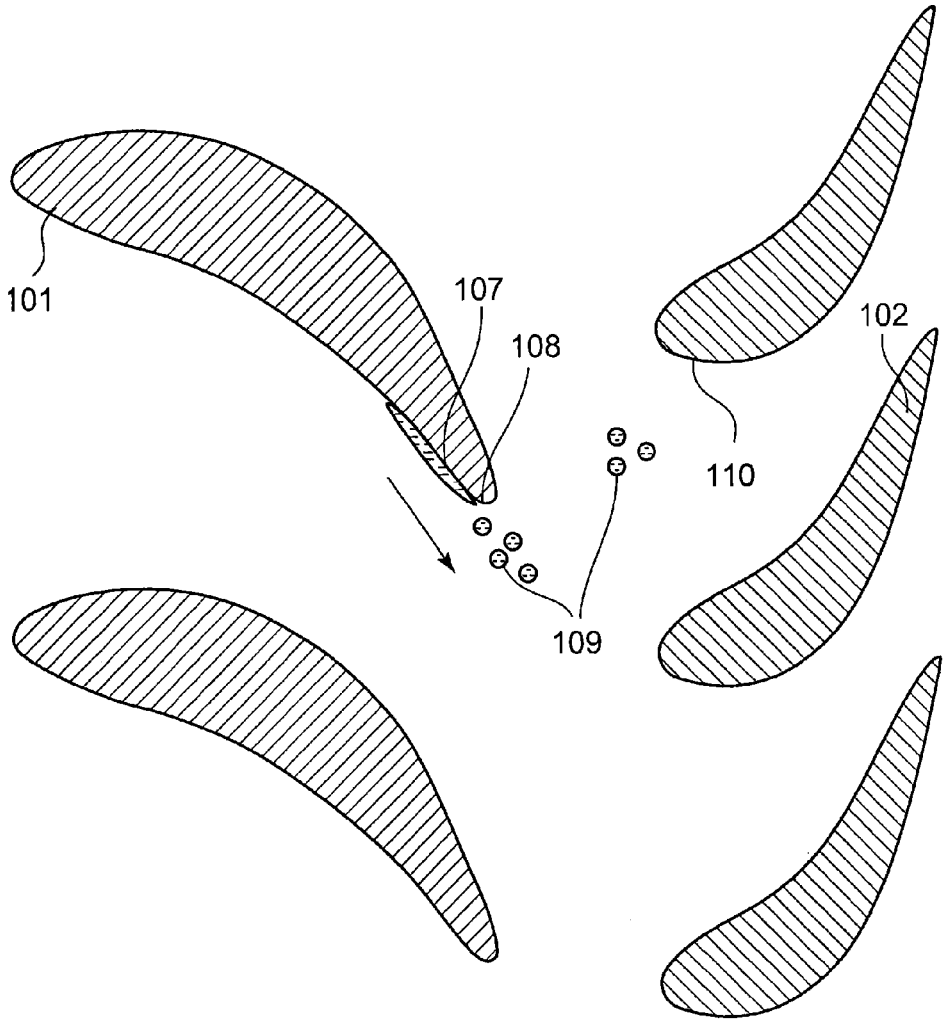
FIG. 12 BACKGROUND ART
FIG. 12 is a view showing a section cut along a line XII-XII in FIG. 11.
Figure 13:
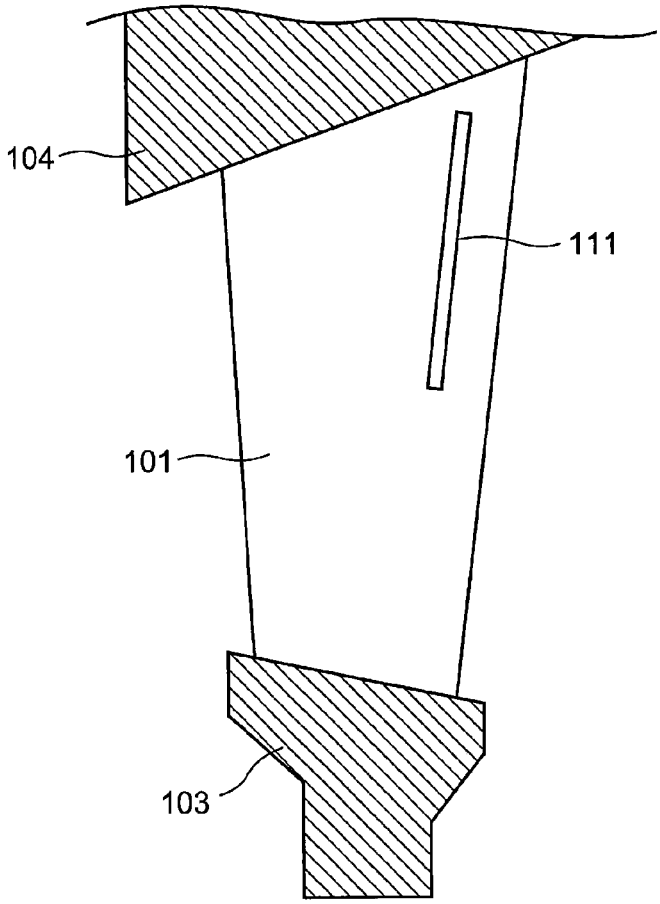
FIG. 13 BACKGROUND ART
FIG. 13 is a sectional view showing the turbine nozzle being viewed from a meridian plane thereof.
Figure 14:
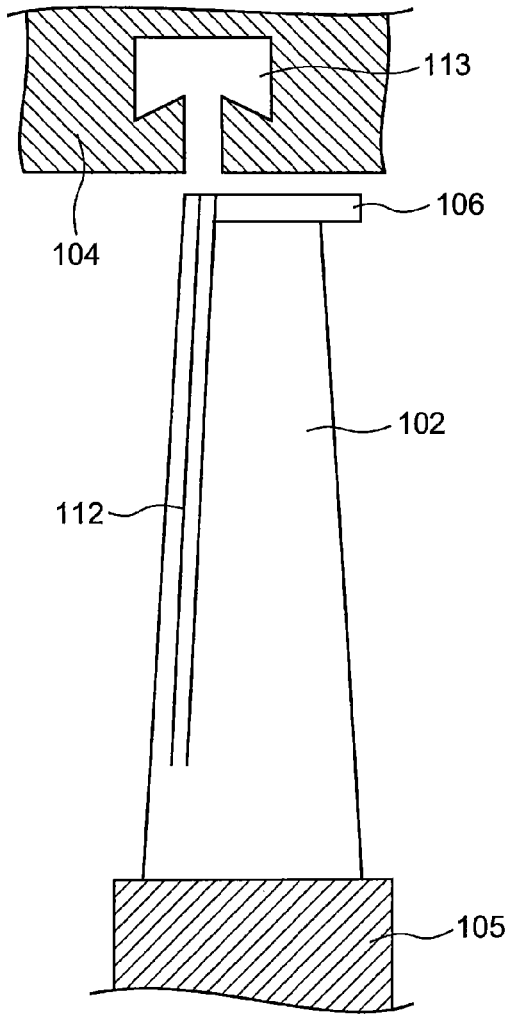
FIG. 14 BACKGROUND ART
FIG. 14 is a sectional view showing the turbine rotating blade being viewed from a meridian plane thereof.
Figure 15:
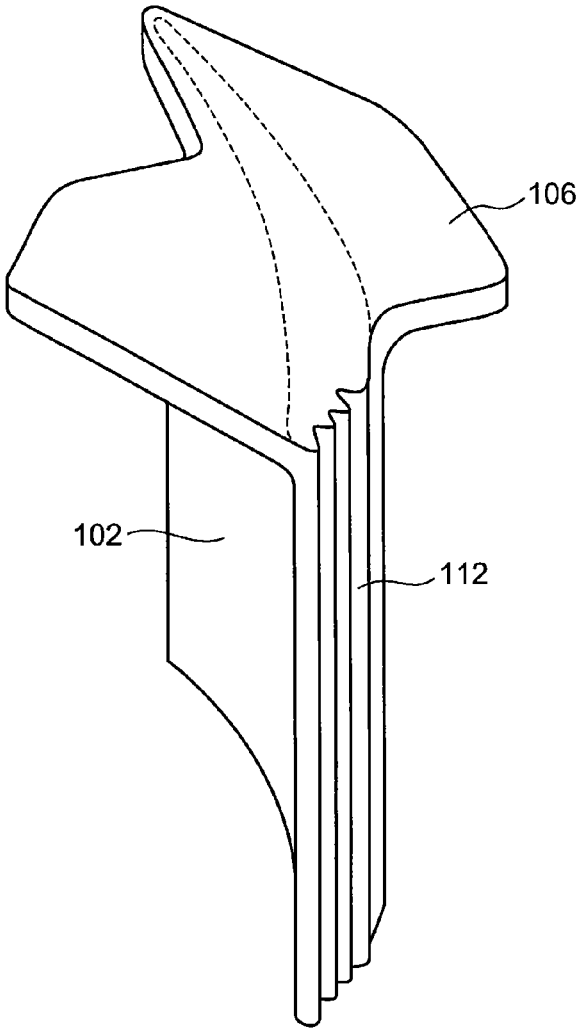
FIG. 15 BACKGROUND ART
FIG. 15 is a perspective view showing a structure of the turbine rotating blade of a conventional steam turbine.

FIG. 10 is a meridional view enlarging a neighborhood of a tip portion of a rotating blade 1 in accordance with the fifth embodiment. An inside surface of a drain pocket 7 formed in the diaphragm outer ring 6 on the outer side of a steam turbine is made to be a sloping surface 41 in the fifth embodiment. This sloping surface 41 slopes in a direction parallel to the rotation axis of the steam turbine, and faces the entrance of a drain pocket 7.

A function of the sloping surface 41 will be described below. Water droplets 9 jump out of a droplet ejection hole 5 arranged on a tip cover 3, and are collected into the drain pocket 7 while drawing substantially an orbit 42. That is, the water droplets 9 jump out of the droplet ejection hole 5 and collide with the sloping surface 41. Subsequently, the droplets 9 are reflected on the sloping surface 41 to be trapped in the drain pocket 7.

When a bottom face of the drain pocket 7 is parallel to the rotation axis of the steam turbine, water droplets 9 collided with the bottom face is reflected on the bottom face and jump out of the drain pocket 7. The water droplets 9 having jumped out are likely to return to the side of the tip cover 3. However, as described above, forming the sloping surface 41 on the bottom face of the drain pocket 7 allows it to prevent the water droplets 9 from returning to the side of the tip cover 3 from the drain pocket 7.

In this embodiment, the sloping surface 41 has been described as a sloping surface sloping from the leading edge of the turbine over the trailing edge thereof toward the inner circumference thereof. Alternatively, the sloping surface may slope from the trailing edge of the turbine over the leading edge thereof toward the inner circumference thereof.

Although the embodiments have been described above with reference to the drawings, the invention is not limited to the embodiments. The invention may adopt various combinations or modifications of the embodiments within the scope of the invention. For example, it is possible to combine the configurations of the rotating blades 1 described in the first to fourth embodiments with the drain pocket 7 described in the fifth embodiment.

While certain embodiments have been described, those embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A steam turbine comprising:

two or more rotating blades; and a diaphragm outer ring arranged on a circumference outside the rotating blades, each of the rotating blades including:

a tip cover which is provided to a tip of each of the rotating blades and is connected in contact with another tip cover adjacent to the tip cover;

moisture-trapping grooves formed in a longitudinal direction of each of the rotating blades on a leading edge of each of the rotating blades;

a droplet ejection hole formed so that the droplet ejection hole connects an outside of the tip cover on a side of the diaphragm outer ring with an inside of the tip cover on a side of each of the rotating blades; and a drain guide groove formed so that the drain guide groove connects ends of the moisture-trapping grooves on the side of the tip cover with the droplet ejection hole, the diaphragm outer ring including a drain pocket which faces the droplet ejection hole.

2. The turbine according to claim 1, wherein the nearer the droplet ejection hole, the deeper the drain guide groove is.

3. The turbine according to claim 1, further comprising a second drain guide groove which is provided to a surface of the tip cover on a side of the rotating blade so that the second drain guide groove crosses between the rotating blades adjacent to each other, wherein the drain guide groove is in communication with the droplet ejection hole via the second drain guide groove.

4. The turbine according to claim 2, further comprising a second drain guide groove which is provided to a surface of the tip cover on a side of the rotating blades so that the second drain guide groove crosses between the rotating blades adjacent to each other, wherein the drain guide groove is in communication with the droplet ejection hole via the second drain guide groove.

5. The turbine according to claim 3, wherein the nearer the droplet ejection hole, the deeper the drain guide groove is.

6. The turbine according to claim 4, wherein the nearer the droplet ejection hole, the deeper the drain guide groove is.

7. The turbine according to claim 1, further comprising a drain guide weir which is provided to a surface of the tip cover on a side of the rotating blades so that the drain guide weir crosses between the rotating blades adjacent to each other and moisture trapped in the drain guide weir moves through the drain guide weir to reach the droplet ejection hole.

8. The turbine according to claim 2, further comprising a drain guide weir which is provided to a surface of the tip cover on a side of the rotating blades so that the drain guide weir crosses between the rotating blades adjacent to each other and moisture trapped in the drain guide weir moves through the drain guide weir to reach the droplet ejection hole.

9. The steam turbine according to any one of claims 1 to 8, wherein a portion of a bottom of the drain pocket is configured to be a sloping surface which slopes in a radial direction of the turbine, the portion facing an entrance of the drain pocket.

* * * * *